US007699349B2

(12) United States Patent
MacWilliams

(10) Patent No.: US 7,699,349 B2
(45) Date of Patent: Apr. 20, 2010

(54) LABEL HAVING FOLDING FEATURE

(75) Inventor: Steven MacWilliams, Fullerton, CA (US)

(73) Assignee: Smead Manufacturing Company, Hastings, MN (US)

( * ) Notice: Subject to any disclaimer, the term of this patent is extended or adjusted under 35 U.S.C. 154(b) by 0 days.

(21) Appl. No.: 12/191,575

(22) Filed: Aug. 14, 2008

(65) Prior Publication Data

US 2008/0305303 A1 Dec. 11, 2008

Related U.S. Application Data

(63) Continuation of application No. 09/690,667, filed on Oct. 17, 2000, now abandoned.

(51) Int. Cl.
*B42F 21/00* (2006.01)
*G09F 3/00* (2006.01)

(52) U.S. Cl. ..... 283/36; 283/39; 283/41; 40/641; 206/820

(58) Field of Classification Search ..... 40/360, 40/641; 206/820; 428/189; 283/26, 29, 283/41; *B42F 19/00, 21/00*
See application file for complete search history.

(56) References Cited

U.S. PATENT DOCUMENTS 2,815,595 A 12/1957 Davis
2,893,144 A * 7/1959 Cunningham ..... 40/641
3,348,324 A 10/1967 Cunningham
3,691,662 A 9/1972 Cunningham
4,201,403 A 5/1980 Turner
5,016,370 A 5/1991 Rhian et al.
5,077,001 A 12/1991 Makowka
5,187,888 A * 2/1993 O'Brien et al. ..... 40/359
5,236,766 A 8/1993 Cole
5,340,629 A 8/1994 Rodighiero
5,462,783 A 10/1995 Esselman
5,503,487 A 4/1996 Ong
5,513,459 A 5/1996 Schneider
5,656,362 A 8/1997 Abrams
5,662,976 A 9/1997 Popat et al.
5,792,536 A 8/1998 Whipp
5,820,958 A 10/1998 Swallow
5,836,622 A 11/1998 Fabel
5,842,722 A 12/1998 Carlson
5,895,075 A 4/1999 Edwards
5,906,397 A 5/1999 MacWilliams et al.
6,257,624 B1 7/2001 Fabel
6,656,558 B1 12/2003 Sarajian

* cited by examiner

*Primary Examiner*—Dana Ross
*Assistant Examiner*—Justin V Lewis
(74) *Attorney, Agent, or Firm*—Altera Law Group, LLC

(57) ABSTRACT

A label including a first layer having a first surface adapted to being printed on and a second layer proximate to a second surface of the first layer. The second layer includes two or more sections having a gap therebetween. Each gap in the second layer defines a fold-line section in the first layer. The second layer covers substantially all of the bottom surface of the first layer except for the fold-line section. Another aspect provides a label having a first layer and a second layer attached to the first layer and having at least two sections separated by a gap, the gap being discernible through the first layer.

16 Claims, 5 Drawing Sheets

LABEL HAVING FOLDING FEATURE

This application is a continuation of application Ser. No. 09/690,667, filed 17 Oct. 2000 now abandoned. The application is incorporated herein by reference.

FIELD OF THE INVENTION

This invention relates to the field of labels, and more specifically to labels for applying to file folders, folder tabs, and other stock members.

BACKGROUND

In many document filing systems, labels are applied to file folders so that the label is located along an edge of one of the folder tabs. The labels are readily visible when the file folders are stored in cabinets or on shelves.

When the labeled folders are put in drawers or on a shelf it is desirable for all the indicia on each label to align from one folder to the next. This is so that when thousands of files are being labeled and stored, any misfiles can be instantly caught by sight. For such a system to work efficiently, the labels must be consistently aligned and the information on each label readily observable.

The application of the labels to the folder tab, however, is problematic. This is because a single user and/or multiple users cannot consistently align or fold each label onto each folder in an exact position so that the correct portion of the label is on each side of the folder tab consistently. Moreover, a user may need to change or replace a label on a folder since the information on the label needs to be updated. However, placing a new label over the label already on the folder may cause the old label to partially show through the new label and make it hard to read the new label.

SUMMARY

Accordingly, for these reasons and others, a label and method providing for ease of placement, alignment, and readability have been developed. An exemplary label includes a first layer having a first label surface adapted to being printed on and a second layer on a second surface of the first layer. The second layer includes two or more sections, wherein between each of the two or more sections is a gap, each gap defining a fold-line section in the first layer. The second layer covers substantially all of the bottom surface of the first layer except for the fold-line section.

Another aspect of the present invention provides a label having a first layer and a second layer. The second layer includes at least two sections separated by a gap which is discernible through the first layer.

Another aspect of the present invention includes a method of applying a label to an edge of a stock member. The method includes applying a first portion of the label to a first side of the edge of the stock member, folding the label along a weakened fold-line running along a surface of the label, and applying the second portion of the label to a second side of the edge of the stock member.

Among other advantages, the present invention provides a label and method for assisting a user in quickly and consistently applying and aligning labels.

DESCRIPTION

In the following detailed description, reference is made to the accompanying drawings that form a part hereof, and in which are shown by way of illustration specific embodiments in which the invention may be practiced. It is understood that other embodiments may be utilized and structural changes may be made without departing from the scope of the present invention. It is also noted that "first," "second," "top," and "bottom" and the like are to be taken in the context of the description and the Figures and are not be taken in an absolute limiting sense.

The description herein will discuss a label form and the application of a label to a file folder. However, it is to be understood that the discussion is merely exemplary and is not meant to limit the use of the exemplary labels to document storage file folders and the like, and that many other uses and applications are within the scope of the present invention.

Figure 1:
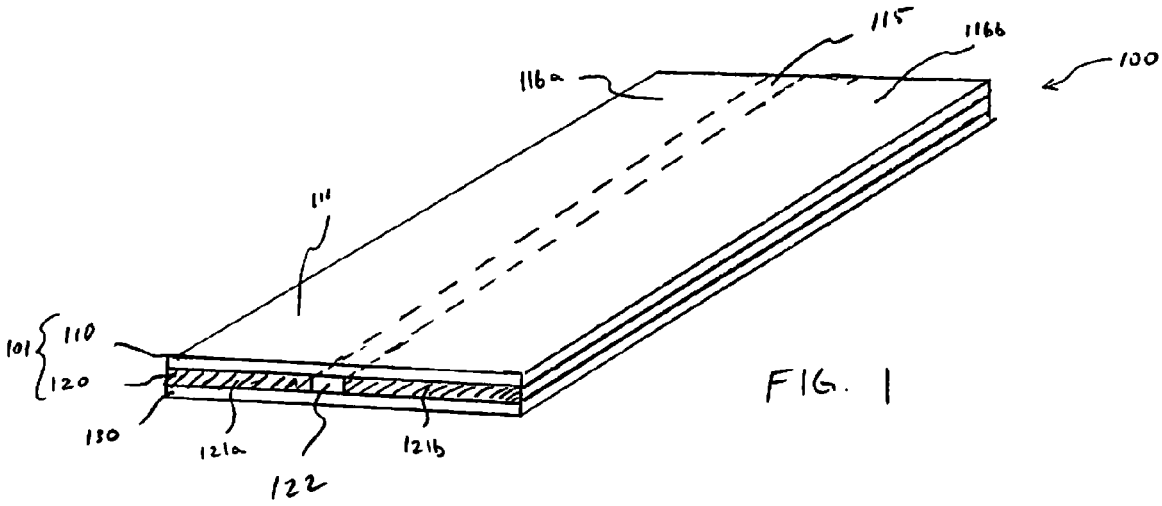
FIG. 1 shows an isometric view of a label form according to one embodiment of the present invention.
Figure 2:
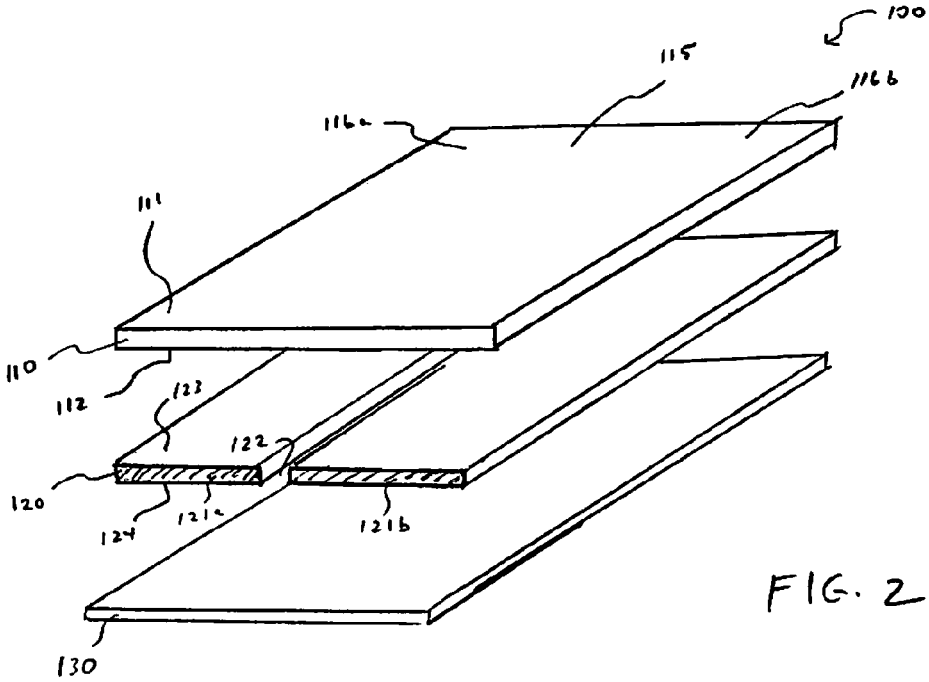
FIG. 2 is an exploded isometric view of the label form of FIG. 1.

FIGS. 1 and 2 show an exemplary label form 100. FIG. 1 shows an isometric view of label form 100, while FIG. 2 shows an exploded isometric view of the label form. Label form 100 includes a label 101 which is removably attached to a backing member 130. Label 101 includes a first layer 110 and a second layer 120.

First layer 110 is a label member which, in one embodiment, has a top surface 111 adapted to being printed on and a second surface 112 having an adhesive, such as a pressure sensitive adhesive, applied thereon. First layer 110 also includes a foldable section or fold-line section 115 which is generally located between a first label portion 116*a* and a second label portion 116*b*. As will be discussed below, the relative sizes of the portions 116*a* and 116*b* of layer 110 can be varied, and thus, the location of foldable section 115 can be anywhere along first layer 110.

In this embodiment, first layer 110 is a light-colored label material which is at least partially translucent so as to permit light to be seen through it. By way of example, but not limitation, such colors include white, yellow, blue, or other light colors. In some embodiments, first layer is a dark color material or a dark color material having a lighter section, as will be discussed below. Layer 110 can be made from a variety of materials such as paper, vinyl, or other plastic composite material.

In the exemplary embodiment, second layer 120 is a label member which includes a first side 123 attached to side 112 of first layer 110. In one embodiment, side 123 includes an adhesive for being attached to side 112. In other embodiments, as discussed above, the adhesive is on the first layer 110. A second side 124 of layer 120 is removably attached to a backing layer or backing member 130. The surface of side 124 has an adhesive, such as a pressure sensitive adhesive, for applying label 100 to a stock member, such as a folder (see FIG. 5).

In the exemplary embodiment, second layer 120 includes two sections, 121*a* and 121*b*, having at least a partial gap or section 122 therebetween. In some embodiments, as will be discussed below, layer 120 includes more than two sections and more than one gap. In this embodiment, gap 122 is a section in the second layer where there is complete separation between the two sections 121*a* and 121*b* of the second layer. However, in some embodiments, gap 122 may only partially separate the two sections. For instance, gap 122 may only run a partial distance along layer 120 so that sections 121*a* and 121*b* are partially connected and partially disconnected. In other embodiments, gap 122 may be a series of perforations, notches, or other partial or complete discontinuity in second layer 120. Thus, the term gap is to be taken as a portion of second layer 120 where there is some discontinuity in the layer.

In one embodiment, second layer 120 is made of a material which is darker or more opaque than the first layer 110. In one embodiment, it is a security label material. In other embodiments, by way of illustration and not limitation, second layer 120 may be black, brown, dark blue, green, or other color or opaque material which permits less light through it than layer 110.

In some embodiments, instead of a discrete material, second layer 120 is a pigment or paint applied directly to the bottom of first layer 110 with gap 122 being defined by where there is a discontinuity of pigment in bottom layer 120 or where a lighter pigment is applied to the bottom of layer 110.

In one embodiment, gap 122 is established by a change in the translucency or color of layer 120. For instance, instead of sections 121*a* and 121*b*, layer 120 can include a single strip with a more translucent portion left as the gap. In other embodiments, as noted above, gap 122 is a narrow strip, a series of perforations, a scored or notched line, or other feature which provides for ease of bending and/or allows a user to visually see where the fold-line is, as will be discussed below.

The gap 122 in second layer 120 defines or establishes where fold-line section 115 is in the top layer. In one embodiment, the gap provides that first layer 110 naturally folds along fold-line section 115 when a folding force is applied to label 101. This means that the label is has a tendency to fold on fold-line section 115 when pressure is applied to the label. In other words, without being specifically manipulated by the user, the label automatically bends or creases along the weakened foldable section. Among other advantages, this provides that any user of a label such as label 101 will always fold the label consistently when applying it to a stock member such as a folder, an index tab, an envelope, or other item being labeled. It also helps ensure that each label will have a consistent placement on the stock member and it helps ensure that each label will have a neat and consistent appearance.

In the exemplary embodiment, the second layer 120 covers substantially all of the bottom surface 112 of first layer 110 except for fold-line section 115. This provides that the label will not bend except at the pre-determined fold-line section 115.

Figure 3:
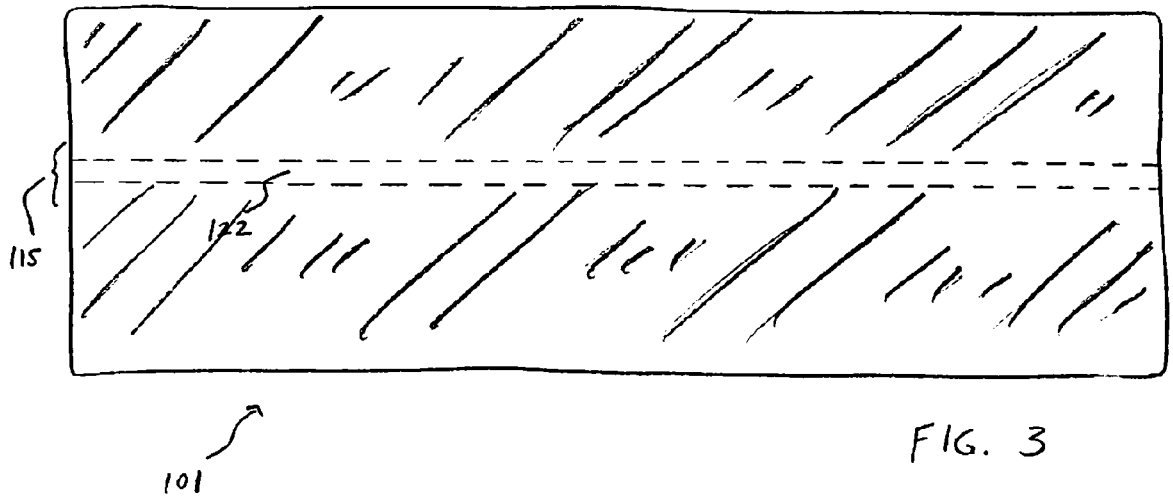
FIG. 3 is a top view of the label form of FIG. 1.

FIG. 3 shows a top view of label 101. As noted above, in one embodiment, first layer 110 comprises a light, transparent or translucent material and second layer 120 includes a dark, or more opaque material. This provides the label with a contrast portion so that user can see fold-line 115. The view of FIG. 3 indicates how light can shine through gap 122 and clearly show the user the correct fold-line. This visual indicator is advantageous for helping a user consistently and quickly apply the label to a stock member, since they will know where it will bend.

Moreover, if the second layer is a dark or opaque material, such as a security label, the label can be put over an old label and the old label will not show through the new one. This provides for a quick way to update file information without having to redo a whole new file folder.

In the embodiment of FIG. 1, label 101 includes an approximately centered gap 122 and fold-line 115. In other embodiments, the fold-line is offset from the center-line of the label.

Figure 4:
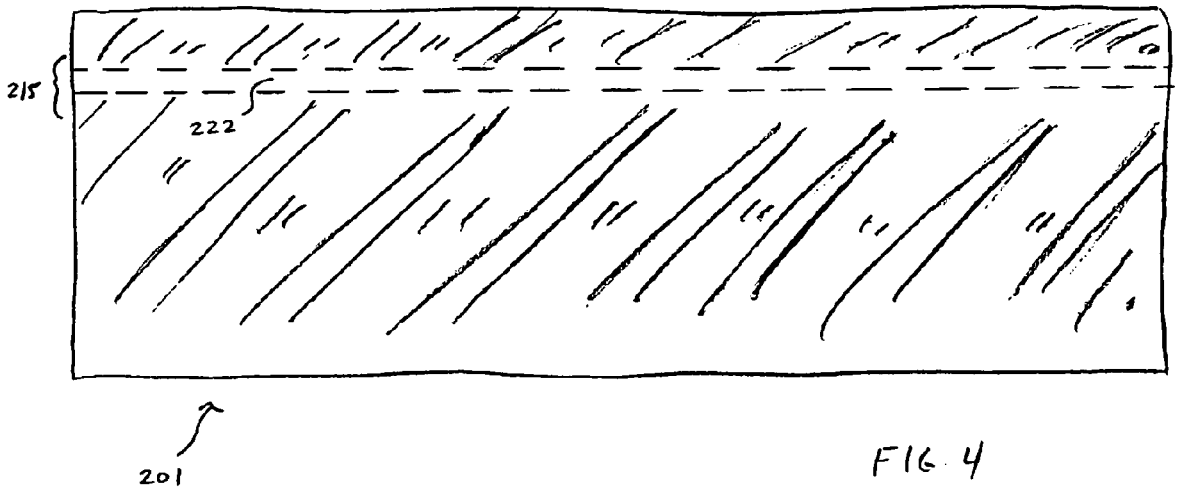
FIG. 4 is a top view of a label form according to another embodiment of the present invention.

FIG. 4 shows a top view of a label 201 according to another embodiment of the present invention. Label 201 has an off-center fold-line 215 defined by the presence of an off-center gap 222 within the second layer. This causes the label to fold correctly, even if a user does not realize that the label was to fold that way (i.e. not symmetrically). In one embodiment, when the two layers have contrasting color tones (or different opacities), this can be helpful in allowing the user predict where the label will bend so that they can align it correctly on the edge of a stock member. In other words, although the user cannot see through the darkened second layer, they can still perceive the fold-line to align and fold the label consistently.

Figure 5:
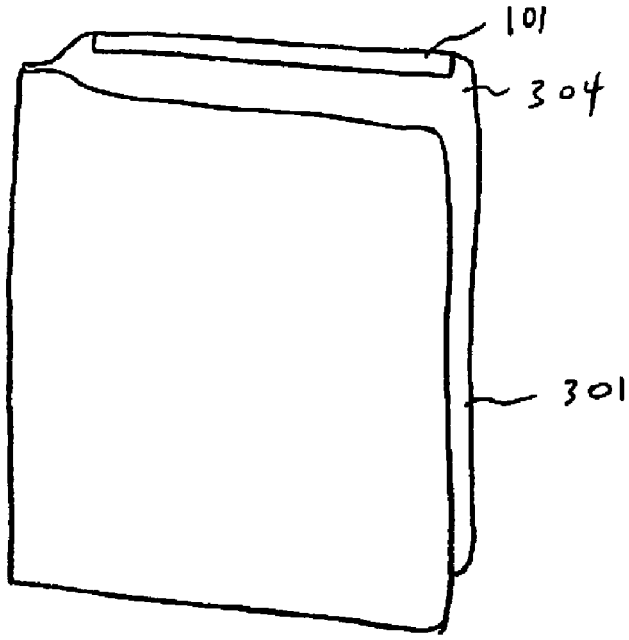
FIG. 5 shows the label of FIG. 1 after the label has been applied to a folder.
Figure 6:
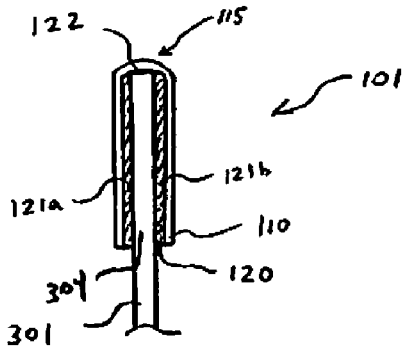
FIG. 6 shows a side view of the label of FIG. 1 applied to a folder.

FIGS. 5 and 6 show a perspective view of label 101 folded over the edge of a folder 301 and a side view of label 101 applied to the folder, respectively. As noted above, folder 301 is merely exemplary and the label can be used with any stock member. Folder 301 includes a portion, such as a tab 304, adapted to receive a label.

To apply label 101, a user removes label 101 from backing member 130. The fold-line is visible because of the contrasting layers. After being aligned, the first portion of the label is applied to the front of tab 304. When the user starts to apply a folding pressure such as applying pressure on the edges of the label or using a folding motion, the presence of gap 122 between portions 121*a* and 121*b* cause the label to fold along line 115. The second portion of the label is then folded over the edge of tab 304 and applied to the other side of the tab so that the final result looks like the labeled folder 301 of FIGS. 5 and 6, in which the two portions of the label member are applied on opposing surfaces of tab 304. The features of label 101 provide that a user will always get a consistent fold in the label, and that multiple users will always get the same fold. In one embodiment, when the first layer and the second layer are label materials, the presence of at least two label layers 110 and 120 provides a thicker, stiffer end-tab for the folder than a single layer label.

Figure 7:
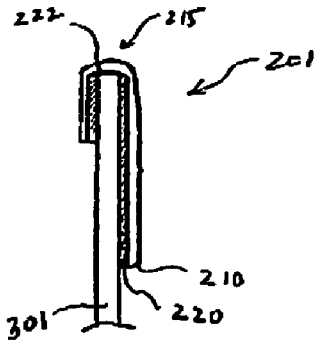
FIG. 7 shows a side view of the label of FIG. 4 applied to a folder.

FIG. 7 shows a side view of label 201 (see FIG. 4) applied to a folder. As noted above, label 201 has an off-center fold-line 215 and gap 222. As discussed above, the presence of gap or section 222 within a second layer 220 causes the label to fold correctly, even if a user does not realize that the label was to fold that way.

Figure 8A:
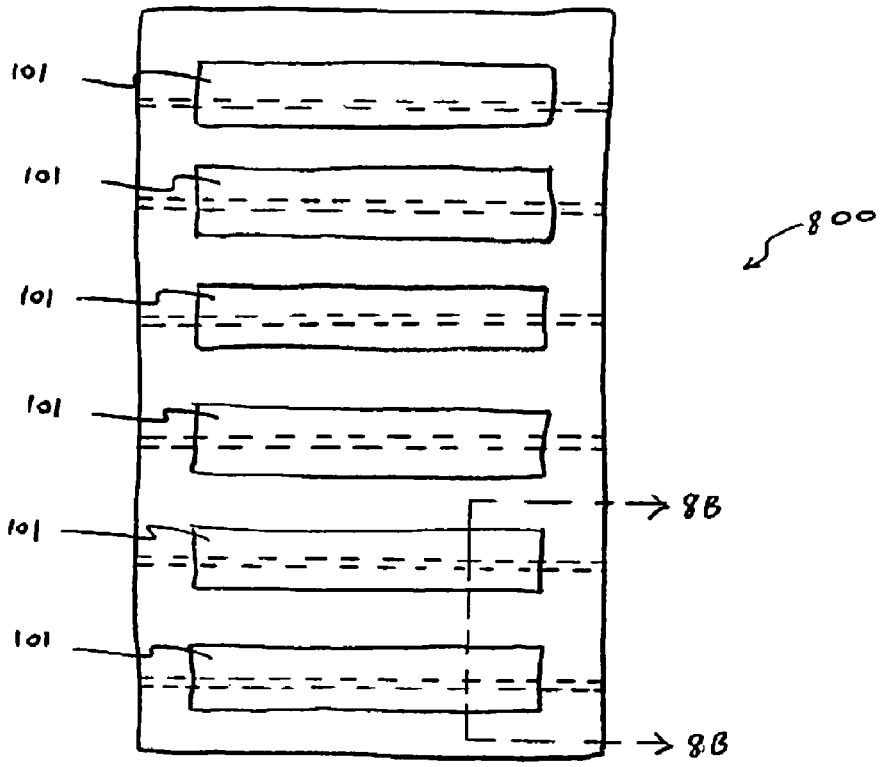
FIG. 8A shows a top view of a label form sheet according to one embodiment of the present invention.

FIG. 8A shows a top view of a label form sheet 800 according to one embodiment of the present invention. Label sheet 800 includes six label members such as labels 101 discussed above. It can include any number of labels.

Figure 8B:
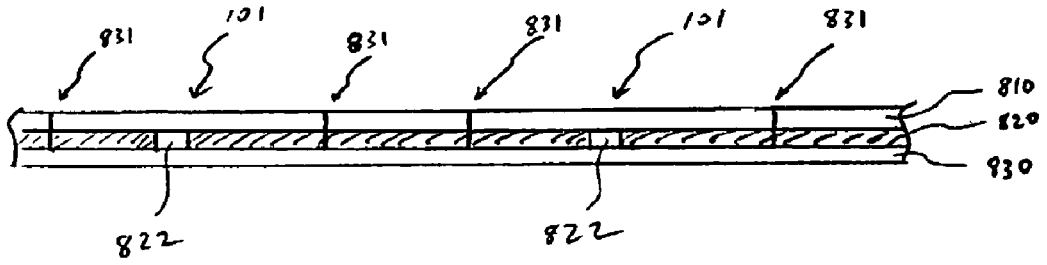
FIG. 8B shows a section view of the label of FIG. 8A.

FIG. 8B shows a sectional side view of label sheet 800. In one embodiment, label sheet 800 is constructed as follows. Layer 820 is attached by a pressure sensitive adhesive to backing member 830. Second layer 820 includes one or more gap sections 822. In this embodiment, second layer 820 is a dark material. First layer 810 is attached to the top surface of second layer 830. The first and second layers are die cut or cut by other means at an edge 831.

In one embodiment, each label member of layer 810 is attached to at least two sections of second layer 820. Each of the one or more label members of layer 810 includes perimeter edge 831 which matches an edge of the at least two sections attached to the label member. As noted above (see FIGS. 3 and 4), labels 101 can be centered or off-center relative to gaps 822.

In various embodiment, the labels can be pre-printed, or blank and printed by the user. Advantageously, in the present embodiment, the first layer and the backing member each comprise a substantially planar surface, wherein the substantially planar surfaces are substantially parallel to one another. This provides ease of use in a printer since no raised edges can get caught in the printer.

Figure 9:
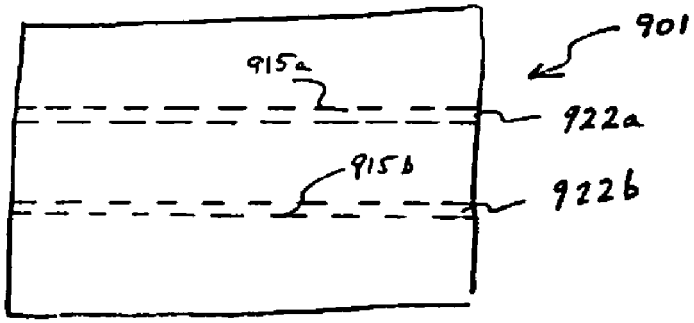
FIG. 9 shows a label in accord with another embodiment of the present invention.

FIG. 9 shows a label 901 in accord with another embodiment of the present invention. In this embodiment, the second layer of label 901 has two gaps 922*a* and 922*b*. This provides two fold-line sections 915*a* and 915*b* in the first layer of the label.

Figure 10:
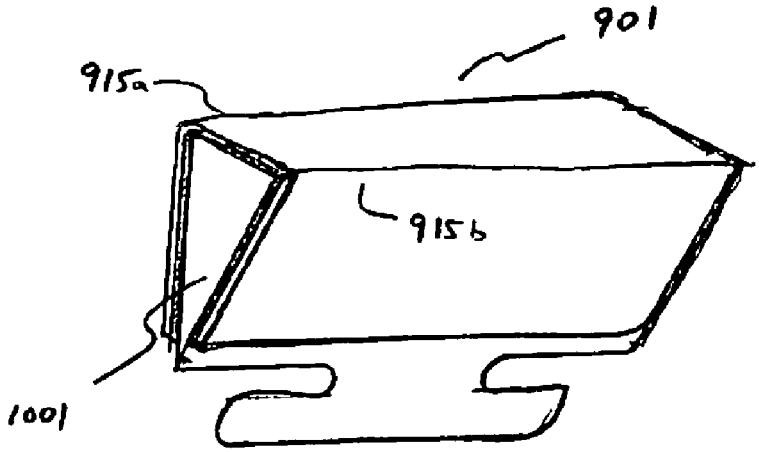
FIG. 10 shows the label of FIG. 9 applied to a three-sided index tab.

FIG. 10 shows label 901 applied to a three-sided index tab 1001. The two fold-lines 915*a* and 915*b* providing a user with automatic folding sections so that the label will not be misapplied.

Figure 11:
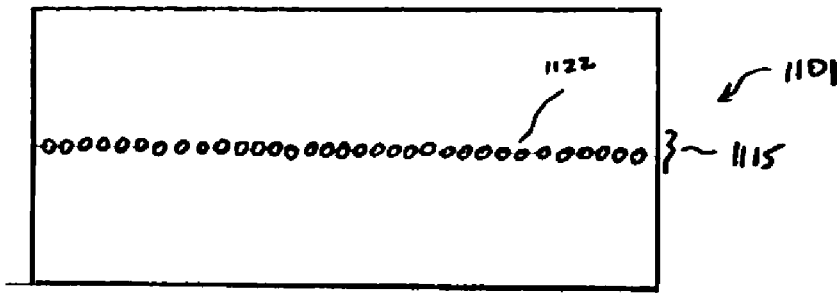
FIG. 11 is a top view of a label according to another embodiment of the present invention.

FIG. 11 shows a top view of a label 1101 according to another embodiment of the present invention. Label 1101 includes a gap 1122 which comprises a series of perforations in the second layer of the label. The perforations provide a weakened fold-line 1115 in the first layer. As noted above, in other embodiments, the gap can be a narrow strip, a series of perforations, a scored or notched line, or other feature which provides for ease of bending and/or allows a user to visually see where the fold-line is.

In other embodiments of the present invention, more or fewer fold-lines can be provided than shown in the exemplary embodiments, depending on the application. Moreover, the shape of the fold-lines can be varied. For instance, gaps such as gap 122 can be other shapes that provide for use on odd shaped folders. For instance, a gap can be contoured to correspond to the contour of an end-tab folder, to provide for physical and visual guidance in applying the label.

Conclusion

When labeled folders are put in drawers or on a shelf it is desirable for all the indicia on each label to align from one folder to the next. However, it is often difficult to apply each label correctly so it is consistent with the other labels. Typically, a single user and/or multiple users cannot consistently align or fold each label onto each folder in an exact position so that the correct portion of the label is on each side of the folder tab consistently. Moreover, a user may need to change or replace a label on a folder since the information on the label needs to be updated. However, placing a new label over the label already on the folder may cause the old label to partially show through the new label and make it hard to read the new label.

Accordingly, for these reasons and others, a label and method providing for ease of placement, alignment, and readability have been developed. An exemplary label includes a first layer having a top surface adapted to being printed on and a second layer proximate to the bottom surface of the first layer. The second layer includes two or more sections having a gap therebetween. Each gap in the second layer defines a fold-line section in the first layer. The second layer covers substantially all of the bottom surface of the first layer except for the fold-line section. Another aspect provides a label having a first layer and a second layer attached to the first layer and having at least two sections separated by a gap, the gap being discernible through the first layer. Among other advantages, the present invention provides a label and method for assisting a user in quickly and consistently applying and aligning labels so that each label will be applied quickly, consistently, and with the same alignment as the labels applied before and after.

It is understood that the above description is intended to be illustrative, and not restrictive. Many other embodiments will be apparent to those of skill in the art upon reviewing the above description. The scope of the invention should, therefore, be determined with reference to the appended claims, along with the fall scope of equivalents to which such claims are entitled.

What is claimed is:

1. A label for attaching over an edge of a stock member to insure reliably folding along a fold-line over said edge the label comprising:

a substantially planar foldable non transparent, translucent first layer having a first surface adapted to being printed on and a second surface on the back side of said first surface, said first layer having a predetermined opacity to light transmission; and a pair of second layers of predetermined widths, each including a material which is permanently attached to the second surface of the first layer, the second surface having an adhesive on an outer surface of the label material, the second layer pairs being spaced apart to define a narrow gap therebetween thereby making said pair of second layer discontinuous with respect to each other, said gap defining a fold-line section in the first layer which bridges said gap, said gap being narrower than either of said second layer pairs to define a predictable fold line, said first and second layers being non-transparent and each limiting the light transmission therethrough by having a second predetermined opacity to light transmission greater than said first predetermined opacity in said first layer, a release layer releasably attached to said second pair of layers, said release layer spanning said gap.

the gap comprising a section spanned by only said first layer, so that the gap is visually discernable because the gap is necessarily more translcent than adjacent portions.

2. The label of claim 1, wherein the second layer pairs is formed by a pigment applied to one face of said first layer.

3. The label of claim 1, wherein the gap comprises a series of perforations having a series of adjacent holes with bridging material in between said holes to join said second layer pair.

4. The label of claim 1, wherein the second layer pair is non-transparent and non-translucent.

5. The label of claim 1, wherein the fold-line section is offset from a centerline of the first layer.

6. The label of claim 1, wherein the second layer comprises three adjacent label portions spaced apart to form two gaps and wherein the label is foldable upon a three dimensional tab member to form a triangular label with two fold lines with three label surfaces capable of carrying imprinted indicia.

7. The label of claim 1, wherein the combination of first and second layers have a greater stiffness than either layer individually and the label has an automatic tendency to fold along said gap.

8. A label foldable along a fold-line comprising:

a substantially planar non transparent, translucent first layer of predetermined light transmissibility; and a second layer of a second predetermined light transmissibility attached to the first layer and having at least two sections at least partially separated by a gap, the gap being visually discernible through the first layer as a result of differential transmissibilities of the different portions of the label, wherein the label fold line can be reliably discerned at said gap as a consequence of lesser light transmissibility on either side of the gap such that the at least two sections are mountable on different surfaces of the stock member when the label is applied over an edge of the stock member and wherein the second layer comprises a visually greater light transmissibility material than the first layer to insure that a user, looking at the first layer can identify the narrow gap and fold accurately along such gap, thereby defining a predictable fold line.

9. The label of claim 8, wherein the second layer comprises a darker material than the first layer.

10. The label of claim 9, wherein the second layer comprises a security label material.

11. The label of claim 8, wherein the gap defines a fold-line section in the first layer.

12. The label of claim 8, wherein the gap is offset from a centerline of the first layer.

13. The label of claim 8, wherein the second layer has at least two gaps and wherein each gap is visible through the first layer.

14. A label comprising:

a first non transparent, translucent layer of predefined light transmissibility, having a top surface adapted to being printed on and a bottom surface; and a second non transparent layer of a second predefined light transmissibility attached to the bottom surface of the first layer, the second layer comprising two or more sections, wherein between each of the two or more sections is a gap, each gap defining a visually discernible fold-line section in the first layer as a result of the differential light transmissibility at said gap, the second layer comprising a darker material than the first layer, wherein each gap is discernible through the first layer and indicates the fold-line section of the first layer, the first layer folds along the fold-line section when a folding force is applied to the label.

15. A three dimensional triangular label with three label surfaces capable of carrying imprinted indicia, initially formed from a planar blank comprising:

a substantially planar first non-transparent, translucent layer of predetermined light transmissibility; and a second non transparent layer of a second predetermined light transmissibility attached to the first layer and having at least a pair of portions each at least partially separated by a relatively narrow gap, the gaps being visually discernible through the first layer as a result of differential transmissibilities of the different portions of the label, wherein the gaps define label fold lines that can be reliably discerned as a consequence of lesser light transmissibility on either side of the gap such that the at least two sections are mountable on different surfaces of the stock member when the label is applied over an edge of the stock member;

so that the label can be formed into a 3-dimensional generally triangular label with folds long said gaps with three label surfaces capable of carrying imprinted indicia.

16. A method of making the fold line a non transparent, translucent label visually discernable comprising the steps in any order, of:

a) cutting a first substantially planar foldable first layer from stock material of a predetermined opacity, into the shape of a label, the label having a first surface adapted to being imprinted with indicia on and a second surface on the back side of said first surface, b) applying a pair of second layers of predetermined widths of a second predetermined opacity greater than said first opacity, to one surface of said first layer in a spaced apart orientation creating a continuous gap, said layers each including a material which is permanently attached to the that surface of the first layer, c) applying an adhesive on an outer surface of the second layer pairs d) locating said second layer pairs on said first layer, but spaced apart to define a narrow gap therebetween making said pair of second layer discontinuous with respect to each other, said gap defining a fold-line section in the first layer which bridges said gap, said gap being narrower than either of said second layer pairs e) defining a predictable fold line along the gap, and f) releasably applying a third release layer attachable to said second pair of layers.

* * * * *